United States Patent [19]

Cochrane

[11] Patent Number: 4,959,916

[45] Date of Patent: Oct. 2, 1990

[54] FRAME APPARATUS

[76] Inventor: Ian R. Cochrane, 23 Guildford Street, Brighton BN1 3LS, United Kingdom

[21] Appl. No.: 294,375

[22] Filed: Jan. 6, 1989

[30] Foreign Application Priority Data

Jan. 12, 1988 [GB] United Kingdom ..... 8800558

[51] Int. Cl.[5] ..... G09F 17/00

[52] U.S. Cl. ..... 40/603; 40/611

[58] Field of Search ..... 40/603, 611, 610

[56] References Cited

U.S. PATENT DOCUMENTS

| | | | |
|---|---|---|---|
| 1,540,516 | 6/1925 | Davis et al. | 40/603 |
| 1,842,274 | 1/1932 | Landwehr et al. | 40/603 |
| 1,974,076 | 9/1934 | Lindenberger | 40/603 |
| 2,072,754 | 3/1937 | Jones | 40/603 |
| 2,720,718 | 10/1955 | Vaniman | 40/603 |
| 3,550,297 | 12/1970 | Friedrichsen | 40/603 |
| 4,580,361 | 4/1986 | Hillstrom et al. | 40/603 |

*Primary Examiner*—Laurie K. Crammer

*Attorney, Agent, or Firm*—Harness, Dickey & Pierce

[57] ABSTRACT

The device comprises frame apparatus that is usable to maintain a poster 7 or other area of sheet material in a substantially taut condition by gently stretching the same. FIGS. 1 and 2 illustrates an embodiment in which the canvas 7 or the like is stretched by helical compression springs 4 in only one direction whereas FIGS. 3 to 6 illustrates an embodiment in which said canvas 7 or the like is stretched by springs 4 and 11 in two coplanar and relatively perpendicular directions. The use of the invention will allow paper and other sheet materials to be displayed in such a way that any small changes in dimensions due to ageing or changes in ambient conditions are automatically compensated for by expansion or contraction of the frame apparatus.

16 Claims, 6 Drawing Sheets

FRAME APPARATUS

This invention relates to frame apparatus.

Existing frames for sheet materials display, protect and aesthetically surround their subjects. Conventional framing methods rely upon displayed material being suspended between a rigid back panel and a transparent front window, which latter is usually glass, said glass or other material being secured in position by a frame moulding or clipping device. This latter is not always required when the protection of the material behind glass is neither necessary nor desirable but the ability clearly to display or otherwise present framed material is an inherent failing or known frame apparatus in that many materials, and particularly paper, expand and contract to a small but significant extent as a result of variations in ambient temperature and humidity. This causes distortion and deterioration of the paper or other sheet materials and conventional framing apparatus also has the disadvantage that its components are governed substantially entirely by the size of the material that is to be displayed.

An object of the present invention is to provide frame apparatus which will display pictures, posters, maps, screens, wallcoverings, textiles and other sheet materials in an attractive manner which is such that frame apparatus constructed in accordance with the invention will very considerably reduce, if not entirely eliminate, the distortion and consequent deterioration that is caused in the manner very briefly discussed above when paper and other sheet materials are displayed in conventional frames.

According to the invention, there is provided frame apparatus for the display of sheet material, the apparatus comprising two spaced frame members that are both telescopically compressible against resilient opposition, two rail members between which an item of sheet material may be arranged in connection with both such rail members, universal pivotal joints at the four junctions between said two telescopic frame members and said two rail members, and stabilising means also interconnecting said two frame members.

Figure 1:
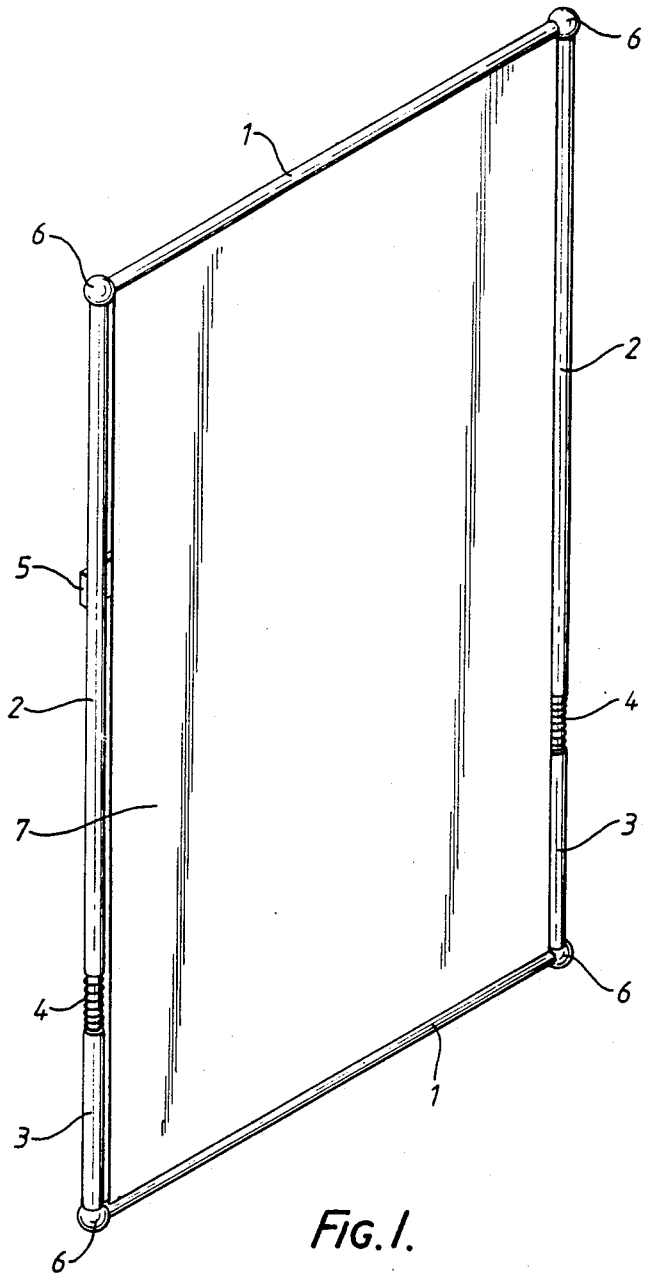
Figure 2:
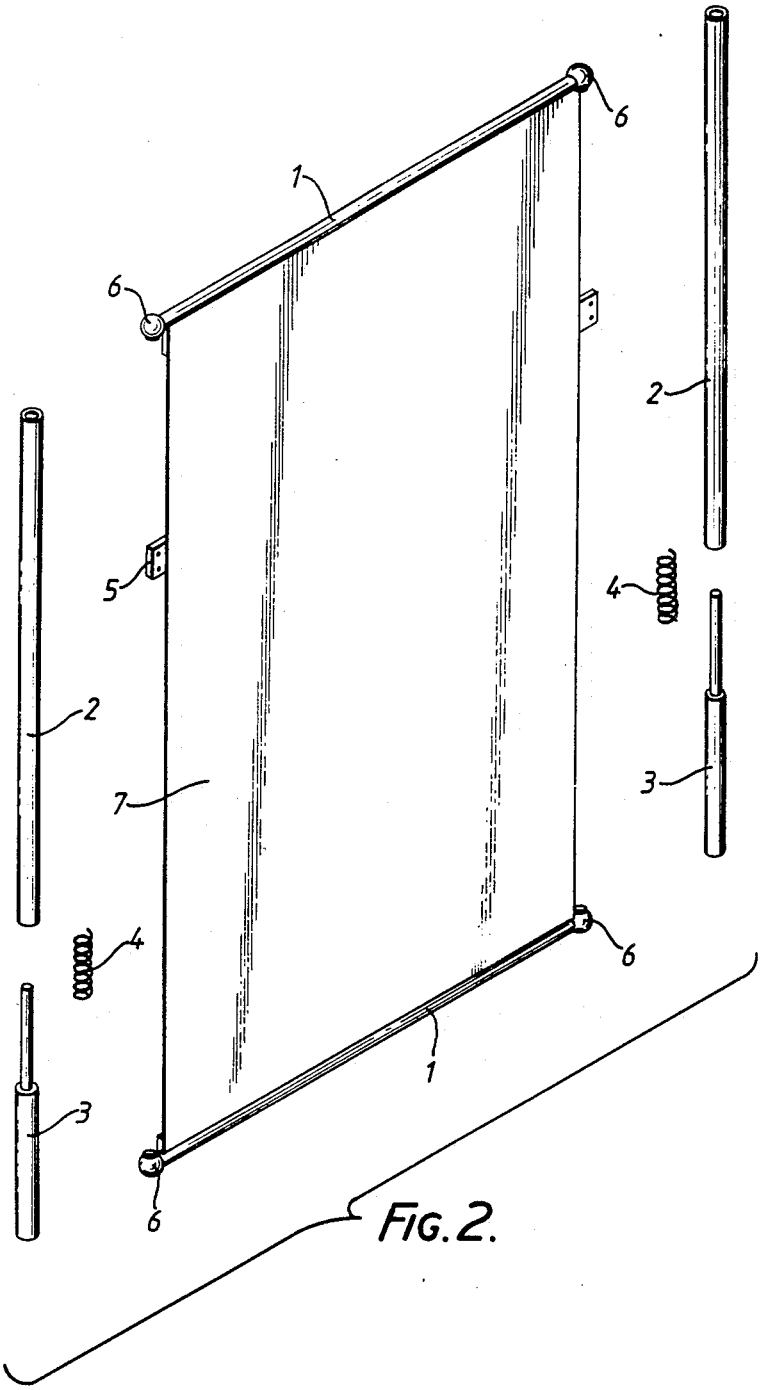
Figure 3:
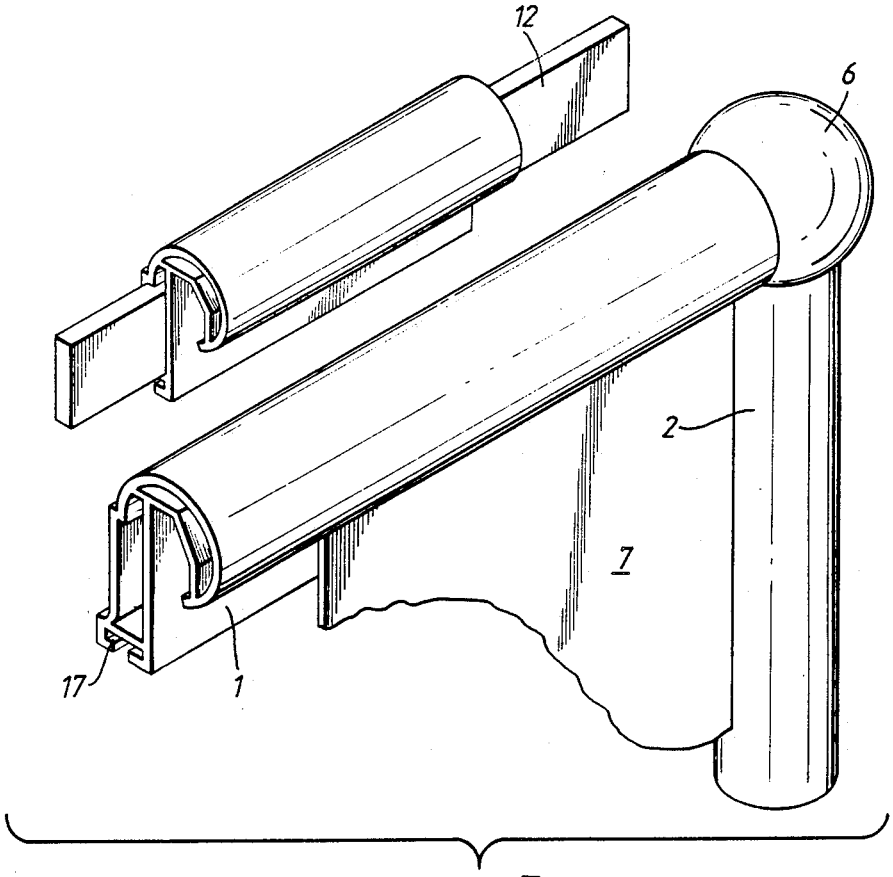
Figure 4:
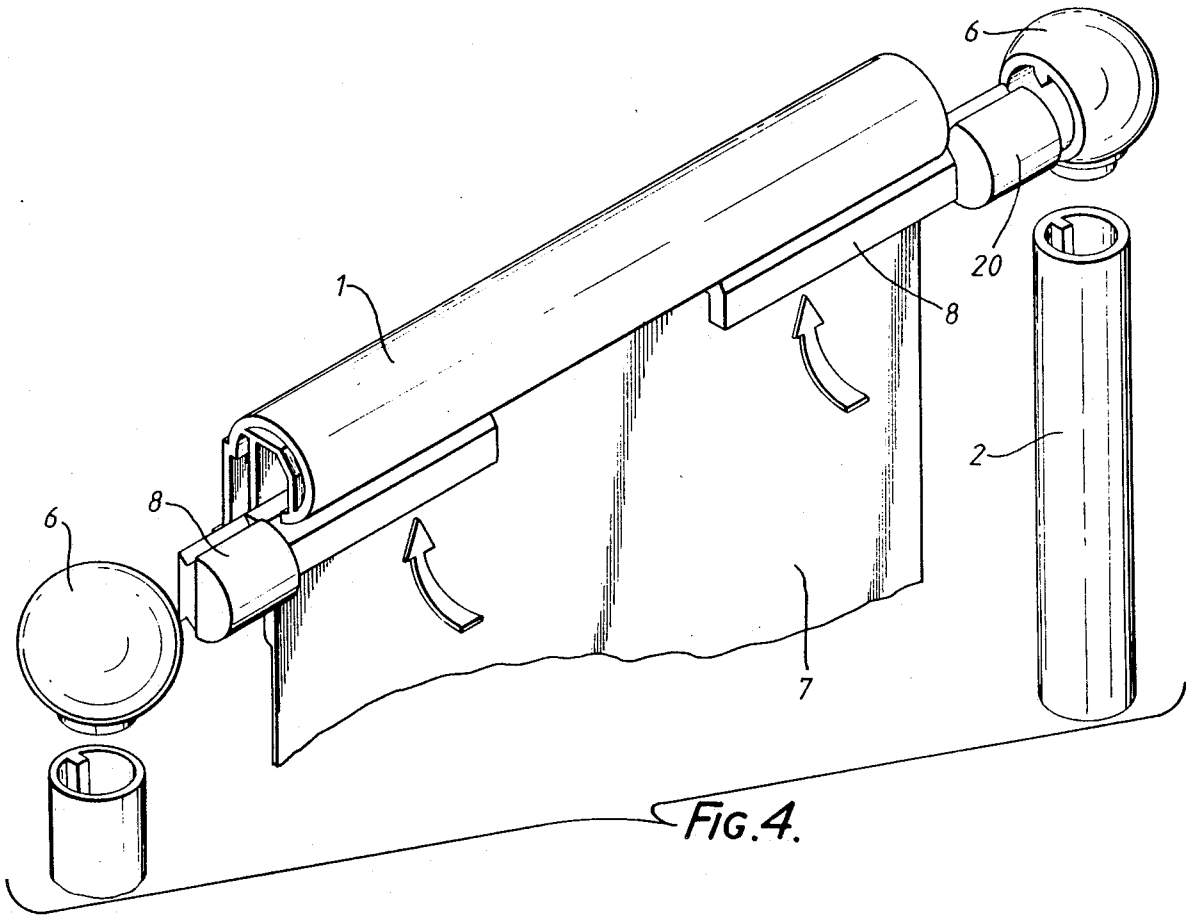
Figure 5:
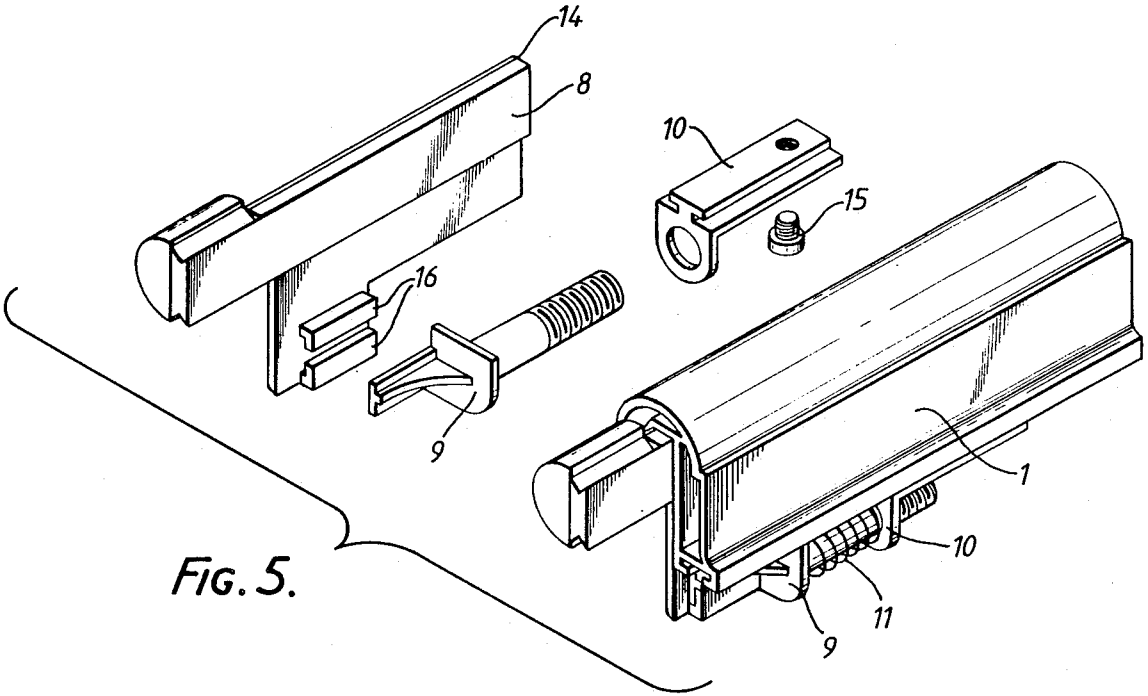
Figure 6:
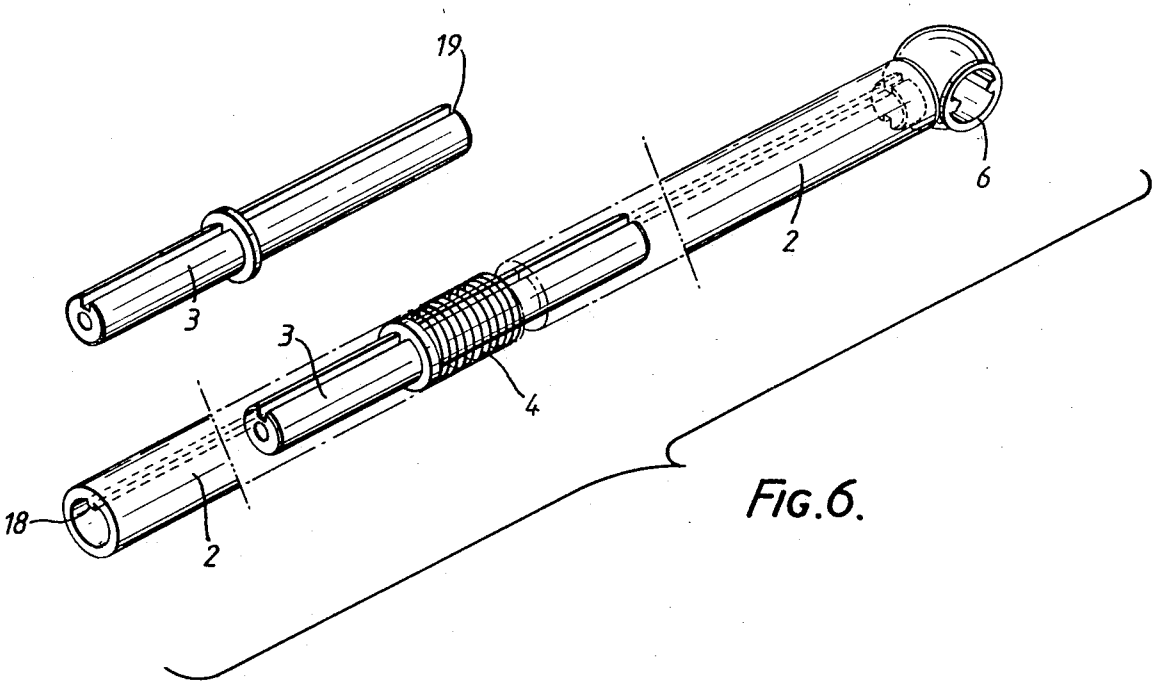

For a better understanding of the invention, and to show how the same may be carried into effect, reference will now be made, by way of example, to the accompanyiny drawings, in which:

FIG. 1 an isometric view of a two-way stretch frame assembled from apparatus in accordance with the invention and shown displaying a poster, FIG. 2 substantially corresponds to FIG. 1 but illustrates the various parts of the frame apparatus in "exploded" relationship with one another before assembly to the frame of FIG. 1, FIG. 3 is an isometric view of one upper corner of a four-way stretch frame assembled from parts in accordance with the invention and shown displaying a poster, FIG. 4 is an isometric view of an upper portion of a four-way stretch frame in accordance with the invention, the view of FIG. 4 being partly "exploded" and illustrating additional members to those that can be seen in FIG. 3, FIG. 5 is an isometric view, both "exploded" and assembled, showing a spring tensioning arrangement associated with, and at the rear of, the parts visible in FIG. 3 and 4, and FIG. 6 is an isometric view showing details of a tubular portion, and of an intermediate member of that portion, at one upright side of the four-way stretch embodiment of FIGS. 3 to 6 of the drawings.

Referring firstly to FIGS. 1 and 2 of the drawings, upper and lower rail members 1 extend in substantially horizontally parallel relationship with one another and are fixedly secured to the upper and lower edges, respectively, of a poster 7. The rail members 1 are preferably, but not essentially, afforded by lengths of metallic or synthetic plastics tube and each of them has two spheres or balls 6 firmly secured to its opposite ends. The particular method by which the upper and lower edges of the poster 7 are secured to the respective rail members 1 may be any one of several known methods and could, for example, be similar to that which will subsequently be described in relation to FIGS. 3 to 6 inclusive of the drawings. Whatever method is employed, the upper and lower edges of the poster 7 should not become detached from the rail member 1 in question when a force is applied thereto in the plane of the poster 7 and in a direction towards the other one of the two rail members 1. In addition to the arrangement that will subsequently be described, any reliable known method involving, for example, clips and/or adhesives and/or stitching and/or an auxiliary batten may be employed.

Two vertically or substantially vertically extending frame members are located in parallel relationship with one another close to the opposite upright edges of the poster 7. Each frame member comprises a tubular portion 2, a second tubular portion 3 of the same diameter as the tubular portion 2 but having a reduced diameter rod projecting axially from one end thereof towards the tubular portion 2 concerned, and a helical compression spring 4 which will engage around the projecting rod of the second tubular portion 3 but which has substantially the same outer diameter as does each of the rod portions 2 and 3. It will immediately be apparent from FIGS. 1 and 2 of the drawings that each opposite frame member is assembled by placing the compression spring 4 around the rod of the corresponding tubular portion 3 and entering that rod into one end of the respective tubular portion 2. The assembled frame member can thus be telescoped to some extent, from a position in which the spring 4 is uncompressed, against the increasing resilient opposition of that spring 4 as the overall length of the frame member is reduced. The mouths of the relatively remote ends of the two tubular portions 2 and 3 of each frame member engage respective ones of the spheres or balls 6 at the ends of the two rail members 1, the length of each rail member being matched to the upright length of the poster 7 in such a way that each of the two springs 4 will have been compressed to a significant, but not the maximum possible, extent when the assembled disposition shown in FIG. 1 of the drawings is achieved.

In order to prevent twisting deformation of the assembled frame apparatus and of the poster 7 which it carries, a stabilizer 5 substantially rigidly interconnects the longer tubular portions 2 of the two opposite frame members. The stabilizer 5 is preferably in the form of a flat, rigid metallic strip and, as can be seen in FIG. 2 of the drawings, its opposite ends are formed with two plain holes through which can be entered screws that can be tightened into engagement with matchingly threaded holes formed in the two tubular members 2 at locations which are not visible in the drawings but which are such that, when said screws are fully tightened, the two tubular members 2 will be maintained in substantially strictly parallel relationship with one another thus ensuring that the fully assembled frame apparatus will not depart to any significant extent from a uniplanar condition.

The metallic parts which afford the springs 4 and conveniently, but not essentially, the items 1, 2, 3, 5 and 6 may be painted, anodised or otherwise treated to give them any desired colour, such as black or white, or may have a matt or shiny metallic finish. The same parts, excepts for the springs 4, may be formed from a strong and rigid synthetic plastics material which latter may have any desired colour. It has been found that the exposed appearance of the springs 4 is quite attractive and there is no need for them to be concealed, but, if, in any particular case, it is preferred that the springs should not be visible, they may easily be concealed, without losing the advantages of the invention, merely by arranging appropriately coloured or otherwise finished synthetics plastics sleeves frictionally around the outer surfaces of the tubular portions 2 or 3 and sliding those sleeves to locations in which they enclose and conceal the springs 4 when the frame apparatus is assembled.

It will be understood that the two opposite frame members, which are telescopically compressed to some extent against the resilient opposition of the springs 4, always maintain the colour printed paper poster 7 in a taut condition, any expansion or contraction thereof which may take place as the result of changes in the ambient temperature or humidity being automatically compensated for by a marginal increase or decrease in the lengths of the two frame members. Since the opposite ends of the two frame members are universally pivotally connected to the opposite ends of the two rail members 1 by the spheres or balls 6, one frame member may expand or contract in length to a marginally different extent to the other without causing any difficulty, the stabilizer 5 always ensuring that no twisting of the complete frame apparatus takes place.

Frame apparatus in accordance with the invention has the considerable advantage that it can quickly and easily be assembled or disassembled, the disassembled parts being capable of being stored in substantially parallel relationship with one another in a tubular holder which can also accommodate the rolled up poster 7 itself. Whilst frame apparatus in accordance with the invention is particularly suitable for the framing and display of posters such as the high-quality printed paper poster 7, other sheet materials and articles such as textiles goods, maps, charts, screens and so on can equally well be displayed. In some cases, gentle stretching of the exhibited sheet material in one direction is sufficient in the manner that has already been described but, with some articles, it is advantageous for them to be gently stretched in two coplanar and relatively perpendicular directions and such an arrangement will subsequently be described with reference to FIGS. 3 to 6 of the drawings.

Whilst the invention provides framing apparatus which is particularly suitable for the display of posters which do not need glass or other transparent material in front of them, this is not always the case and, where a pane of glass or other transparent material is required to protect the sheet material that is being displayed, such a pane can be suspended, immediately in front of the displayed sheet material, from the upper rail member 1. Provided the lower edge of this transparent pane is not rigidly secured to the lower rail member 1, the advantages offered by apparatus in accordance with the invention can still be fully enjoyed.

In the embodiment that has so far been described, it is preferred that the tubular parts 1, 2 and 3 should be of circular cross-section but this is not essential and a regular or irregular polygonal cross-section may, if preferred, be employed.

Referring now to FIGS. 3 to 6 inclusive of the drawings, these Figures illustrate an arrangement in which, as previously mentioned, a high-quality colour printed paper poster 7 is, in the use of the apparatus, gently stretched in two coplanar and relatively perpendicular directions. Parts that are basically similar to parts that have already been described with reference to the FIGS. 1 and 2 of the drawings, even though they may have a somewhat different shape in this embodiment, are denoted by the same references as have already been used above. FIGS. 3 and 4 of the drawings, show a preferably synthetic plastics upper rail member 1 that extends in a substantially horizontal direction and that is parallel or substantially parallel to a similar lower horizontal rail member that is not shown in the drawings. Both these upper and lower horizontal rail members 1 are fixedly but releasably secured to corresponding pairs of corner clamps 8.

Each corner clamp 8 is preferably, but not essentially, formed from a substantially rigid synthetic plastics material and comprises two portions that are foldably interconnected at their inner ends about axes which, in the use of the frame apparatus, will usually be substantially vertically disposed. The two portions in question comprise a front portion as seen in FIG. 4 of the drawings and a rear portion which is best seen in FIG. 5 of those drawings. The substantially vertical axis that has just been mentioned is designated by the reference 14 in FIG. 5 of the drawings. The two portions are shown engaged with one another but can, in fact, be relatively turned about the axis 14 which axis is conveniently afforded by a "thin" portion of the synthetic plastics material When parted from one another, the corresponding corners of the poster 7, or any other material that is to be displayed, are entered between them and said portions are closed together with the corresponding corner of the poster 7 sandwiched therebetween. To this end, the rearward portion has a forward and upward projection not visible) which fits in a forwardly and upwardly extending recess (again not visible) in the forward portion. The projection and recess that have just been mentioned retainingly interengage one another and the corresponding corner of the poster 7, or other sheet material that is to be displayed, can easily be engaged between them so as to extend into the recess of the forward portion and around the projection of the rearward portion. Once this engagement of the two corner clamps 8 with the poster 7 or the like has been effected, the two upper corner clamps are suspended inside the upper rail 1, the shape of this rail 1 being such that, as can be seen in FIGS. 3 and 4 of the drawings, the interengaged portions of each clamp 8, with the poster 7 or the like between them, can be pushed upwardly in the directions of the arrows shown in FIG. 4 at which time upward and rearward inclines towards the top of the front portion of each corner clamp 8 will push the curved front of the rail 1 forwardly and outwardly until the corner clamps 8 snap into position internally of the rail 1 where, nevertheless, they can move short distances to-and-fro lengthwise of that rail 1.

In order to maintain tension in a direction parallel to the length of the upper rail member 1 as seen in FIGS. 3 and 4 of the drawings, a spring assembly is provided for each corner member 8 but at the rear thereof with respect to FIGS. 3 and 4 so that it is normally concealed. Each spring assembly comprises a helical compression spring 11 (FIG. 5) surrounding part of a connection member 9 and bearing between that connection member 9 and an adjustment member 10 which is secured in a fixed position, for as long as may be required, by a grub screw 15. It can be seen in FIG. 5 that the connection member 9 also comprises a substantially vertical stop to the left of which (in FIG. 5) there is a connector of T-shaped cross-section which connector fits in a slideway 16 of matching cross-section. A cylindrical portion to the right (as seen in FIG. 5) of the stop forming part of the connection member 9 is calibrated and is entered through a ring, forming part of the adjustment member 10, with only a minimum of clearance between that ring and the calibrated cylindrical portion so that the compression spring 11 can bear reliably between the stop of the portion 9 and the ring of the portion 10.

A recess 17 of T-shaped cross-section is formed at the bottom of the upper rail member 1 in such a way that its open-bottomed upright projects downwardly. This recess 17 receives a correspondingly shaped projection at the top of the adjustment member 10 which can thus slide lengthwise along the bottom of the upper rail member 1. A screw-threaded hole is formed in the T-shaped projection of the member 10 and receives the grub screw 15 which can be tightened to retain the member 10 at any chosen position lengthwise of the recess 17 at the foot of the rail member 1 and, clearly, a position is chosen for each member 10 which is such that the stop of the corresponding member 9 is firmly in engagement with the right-hand end (as seen in FIG. 5) of the corresponding slideway 16. Thus, the adjustment member 10 is secured to the rail member 1 but can have its fixed position readily changed merely by temporarily releasing, and subsequently retightening, the grub screw 15 whereas the spring 11 urges the stop of the connection member 9 away from the ring of the adjustment member 10, said adjustment member being fixedly but temporarily connected to the corresponding corner clamp 8 which, as previously mentioned, can slide lengthwise to-and-fro in the hollow interior of the upper rail member 1. The calibrations on the cylindrical portions of the two connection members 9 corresponding to each rail member are very useful in either setting or changing the tension to which the poster 7 or the like will be subject in a substantially horizontal direction that is substantially parallel to the length of each rail member 1.

FIG. 6 of the drawings illustrates one of the two normally vertically disposed frame members at the opposite substantially vertical sides of apparatus in accordance with the invention. The arrangement is basically similar to that which has already been described with reference to FIGS. 1 and 2 of the drawings except that each tubular portion 2 is formed in two separate parts that are of the same diameter and are interconnected by a corresponding intermediate portion 3 that includes a stop and between which stop and one end of one of the two separate parts that has just been mentioned extends a helical compression spring 4. In addition, the two parts of each tubular portion 2 are formed, internally, with a rib or spline 18 and the intermediate portion 3 is formed throughout its length with a recess or groove 19 that matches the rib or spline 18. Thus, as can be seen in FIG. 6 of the drawings, the two parts of the tubular portion 2 and the intermediate portion 3 can move axially relative to one another but cannot turn with respect to one another about their combined longitudinal axis to any significant extent.

In the embodiment of FIG. 3 to 6 of the drawings, a ball 6 is again provided at each of the four corners of the frame apparatus and some details thereof can be seen in FIGS. 4 and 6. Each ball 6 presents, at 90° to one another, an opening or recess formed internally with two opposite ribs or splines that are 180° removed from one another around the centre of the recess and also a projection which is formed with two recesses or grooves that are spaced apart from one another at 180° around the centre of the projection. As seen in FIG. 6, one of these two recesses that has just been mentioned engages the rib or spline 18 of one of the two parts of the tubular portion 2 that is shown in that Figure. The same arrangement can be seen in exploded relationship at both sides of FIG. 4 of the drawings from which it will also be apparent that the recess of each ball 6 receives a shaped portion 20 of the corresponding corner clamp 8 which shaped portion 20 includes upper and lower recesses or grooves. Each shaped portion 20 can be entered into the recess of the corresponding ball 6 at which time both the upper and lower recesses or grooves in the shaped portion 20 concerned will engage the two internal ribs or splines in the recess of that ball 6. The various ribs or splines and matching recesses that have been described enable axial displacements to take place as may be required without, however, allowing any significant twisting of the apparatus out of a substantially uniplanar condition, these parts thus stabilising the frame and taking the place of the previously described stabilizer 5 to ensure that no significant twisting of the complete frame apparatus can take place.

If the frame apparatus is to keep relatively heavy materials equivalent to the poster 7 in a taut condition, it is desirable that a strengthening bar 12 whose position can be seen in FIG. 3 should be entered lengthwise through a tubular opening formed towards the rear of each rail member 1. When a large frame is involved, which might be used in, for example, a shop fitting or exhibition, the bar 12 might conveniently be extruded from aluminium or steel and, whilst providing the strength that is necessary in both the upper and lower rail members 1, will tend to correct any minor irregularities or distortions produced during the extrusion of the rail 1 itself. A frame member in accordance with the invention can conveniently be suspended from at least one keyhole-shaped eye or the like (not shown) which includes a perpendicularly projecting T-shaped portion that can be entered in the same matching recess 17 that receives the adjustment members 10. The or each eye itself will normally be hidden at the rear of the frame apparatus when the latter is in use and is, of course, adjustable lengthwise of the recess 17 as may be required.

I claim:

1. A frame apparatus for the display of sheet material, comprising:

two spaced frame members that are both telescopically compressible against resilient opposition, two rail members between which an item of sheet material may be arranged in connection with both such rail members, corner joints at junctions between said two telescopic frame members and said two rail members, and stabilizing means also interconnecting said two frame members;

wherein said apparatus is constructed and arranged to gently stretch exhibited sheet material in two coplanar and relatively perpendicular directions; and wherein the means by which material to be displayed is fixedly connected to the rail members comprises corner clamps each formed in two parts which are pivotable relative to one another about an axis which, in use, will be substantially vertically disposed, said two parts comprising interengaging projections and recesses between which a corresponding corner of the material to be displayed can be retainingly entered.

2. A frame apparatus for the display of sheet material, comprising:

(a) two frame members both telescopically compressible against resilient opposition;

(b) two rail members;

(c) attaching means for attaching an item of sheet material to said frame apparatus, the attaching means being provided only adjacent corners of the sheet material;

(d) biasing means acting on the attachment means for keeping said sheet material in a stretched condition in the lengthwise direction of said rail members; and (e) corner joints for connecting said rail members to said frame members, so that said frame apparatus is in a substantially uniplanar condition, whereby said sheet material is stretched in said lengthwise direction of said rail members by said biasing means, and is stretched in a direction, coplanar with and perpendicular to said lengthwise direction, by said frame members, wherein any expansion or contraction of said sheet material is compensated for by said biasing means and said frame members.

3. A frame apparatus according to claim 2, wherein said attaching means comprises four corner clamps, positioned one adjacent each corner of the sheet material, each corner clamp being formed of two parts which interengage with one another to sandwich said sheet material therebetween.

4. A frame apparatus according to claim 3, wherein said biasing means comprises spring means which urge said corner clamps away from each other in a direction parallel to said rail members.

5. A frame apparatus according to claim 4, wherein said corner clamps are movable along said rail members.

6. A frame apparatus according to claim 2, including a stabilizing bar substantially rigidly secured to said frame members at locations spaced from said rail members, whereby said stabilizing bar will maintain said frame members in substantially parallel relationship with one another.

7. A frame apparatus according to claim 2, including ribs and matching recesses formed in said frame members, said rail members and said corner joints.

8. A frame apparatus for the display of sheet material comprising:

(a) two frame members each telescopically compressible against resilient opposition;

(b) two rail members extending between said frame members and connected to the ends of said frame members by corner joints for maintaining said frame apparatus in a substantially uniplanar condition;

(c) clamping means, movable lengthwise along said rail members for connecting said sheet material to said rail members; and (d) biasing means for biasing said clamping means, in use said biasing means biasing said clamping means to stretch said sheet material in said lengthwise direction of said rail members, said frame members stretching said sheet material in a direction substantially perpendicular to and coplanar with said rail members, wherein any expansion or contraction of said sheet material is compensated for by the telescoping of said frame members and the movement of said clamping means along said rail members.

9. A frame apparatus according to claim 8, wherein said clamping means comprises four corner clamps, positioned one adjacent each corner of said sheet material, said corner clamp being formed of two parts which interengage with one another to sandwich said sheet material therebetween.

10. A frame apparatus according to claim 9, wherein said biasing means comprises four spring means, two on each said rail member, each said spring means being movable along the corresponding rail member to engage with one of said corner clamps to urge said corner clamps on said rail member away from one another, said spring means being lockable in position at selected locations on said rail members.

11. A method of displaying a sheet of material, comprising the steps of:

(a) attaching a clamp to each end of upper and lower edges of said sheet material;

(b) attaching said clamps on said upper edge to an upper rail member, said clamps being movable lengthwise along said upper rail member;

(c) attaching said clamps on said lower edge to a lower rail member, said clamps being movable lengthwise along said lower rail member;

(d) attaching two frame members, both telescopically compressible against resilient opposition, between said rail members, one frame member at either end of said rail members, to tension the sheet material in one direction; and (e) engaging biasing means, fixed to said rail members and movable lengthwise therealong, with said clamps to cause said clamps to stretch said sheet material in the direction of said rail members substantially perpendicular to and coplanar with said one direction.

12. A method of displaying a sheet of material according to claim 11, wherein each said clamp comprises two parts which are interengageable with each other, said clamps being attached to said sheet material by placing said sheet material between said two parts and then interengaging said two parts to sandwich said sheet material therebetween.

13. A frame apparatus for the display of sheet material, comprising:

(a) two frame members and two rail members;

(b) corner joints enabling the frame and rail members to be assembled into a substantially uniplanar frame assembly;

(c) clamping means for engagement with adjacent corners of an item of sheet material to be displayed, each clamping means comprising a corner clamp formed of two parts which interengage with one another to sandwich an edge portion of the sheet material therebetween; and (d) spring biasing means for urging opposed pairs of the corner clamps away from one another in a direction parallel to the frame members and in a direction parallel to the rail members;

the sheet material being stretched by the spring biasing means in a lengthwise direction of the frame members and a lengthwise direction of the rail members so that any expansion or contraction of the sheet material is compensated for.

14. A frame apparatus according to claim 13 wherein the frame members are telescopic, and the biasing means for urging the corner clamps away from each other in the direction parallel to the frame members comprises spring means associated with the telescopic members.

15. A frame apparatus as claimed in claim 14, wherein the corner clamps are mounted to said rail members.

16. A frame apparatus as claimed in claim 15, wherein the corner clamps are slidably mounted to said rail members and said biasing means for urging the corner clamps away from one another in a direction parallel to said rail members comprises spring means acting between said corner clamps and said rail members.

* * * * *